United States Patent [19]

Takashima et al.

[11] Patent Number: 4,778,740

[45] Date of Patent: Oct. 18, 1988

[54] COLOR ELECTROPHOTOGRAPHIC METHOD AND APPARATUS

[75] Inventors: Yuji Takashima, Nishinomiya; Hajime Yamamoto, Ibaraki, both of Japan

[73] Assignee: Matsushita Electric Industrial Co., Ltd., Osaka, Japan

[21] Appl. No.: 30,663

[22] Filed: Mar. 27, 1987

[30] Foreign Application Priority Data

| | | | |
|---|---|---|---|
| Mar. 31, 1986 | [JP] | Japan | 61-73557 |
| Mar. 31, 1986 | [JP] | Japan | 61-73558 |
| May 8, 1986 | [JP] | Japan | 61-105212 |

[51] Int. Cl.[4] ..... G03G 13/01; G03G 15/01

[52] U.S. Cl. ..... 430/42; 430/43; 430/45; 355/4; 355/8

[58] Field of Search ..... 430/42, 43, 45; 355/4

[56] References Cited

U.S. PATENT DOCUMENTS

| | | | |
|---|---|---|---|
| 3,615,391 | 10/1971 | Honto et al. | 430/43 |
| 4,039,831 | 8/1977 | Lehmann | 430/42 X |
| 4,599,285 | 7/1986 | Haneda et al. | 430/42 X |
| 4,634,259 | 1/1987 | Oishi et al. | 430/42 X |

*Primary Examiner*—Roland E. Martin

*Attorney, Agent, or Firm*—Stevens, Davis, Miller & Mosher

[57] ABSTRACT

Disclosed is a color electrophotographic method of forming a plurality of images of different colors on a photosensitive medium by repetitions of a series of operations including steps for charging, exposure and development. An exposure of photosensitive medium is conducted to form an electrostatic latent image adjacent to a first toner image which has been formed in the previous process with a non-image are provided at the boundary of the first toner image. The difference in potentials between the toner image and the adjacent image is thereby eliminated, thus preventing scattering of toner particles. This results in a clear color print the colors of which are not blurred and of high purity.

4 Claims, 7 Drawing Sheets

COLOR ELECTROPHOTOGRAPHIC METHOD AND APPARATUS

BACKGROUND OF THE INVENTION

1. Field of the Invention

The present invention relates to a color electrophotographic method and apparatus which can be applied to apparatus for producing hard copies of color images, such as color copiers, color printers and so forth. More specifically, the present invention is directed to a color electrophotographic method and apparatus such as a light source scanning-exposure type in which a series of operations including steps for charging, exposure and development is conducted cyclically so as to form a plurality of toner images of different colors on an electrophotographic photosensitive medium (hereinafter referred to as a photosensitive medium) and these toner images are transferred in one step onto a sheet of paper.

2. Description of the Prior Art

Such a known color electrophotographic method (types of which are disclosed in, for example, the specifications of Japanese patent Laid-Open No. 95456/1985 and U.S. Pat. No. 4,599,285) has certain disadvantages in that (1) the boundaries of images of different colors which are formed adjacent to each other may be blurred or the width of previously formed color image forming lines may be decreased when the next color image is formed, and (2) the toner particles forming the images may be scattered and the entirety of the images blurred when the electrostatic latent images on the photosensitive medium carrying the toner images are erased by light irradiatied onto the photosensitive medium.

The disadvantages of the conventional apparatus to be overcome will be hereinunder described in detail by referring to FIGS. 4*a* to 4*f* which illustrate the process of forming second toner images on a photosensitive medium carrying first toner images that have been formed in the previous process.

The photosensitive medium 2 which carries the first toner images 1 formed by a toner of an opaque color such as black is charged a second time to a surface potential of Vs by a corona charger 3 (FIG. 4*a*). Next, the areas D and F which are adjacent to the toner image on the area E are exposed (as shown by the arrows) (FIG. 4*b*) to form electrostatic latent images, so that the surface potential of these areas is attenuated to that of the residual potential (Vr) of the photosensitive medium (FIG. 4*c*). This generates a large difference in the potentials at the boundaries between the area E and the areas D and F, and the toner particles located in the vicinity of the boundaries are thereby scattered along the lines of electric force which are directed toward the areas D and F from the edges of the area E, thus making the width of the toner image 1 smaller.

As a consequence, when the electrostatic latent images are developed by a second toner 4 of a color which is different from that of the first toner 1 (FIG. 4*d*), the color purity of the second toner images is degraded by the first toner particles 1 that have scattered to the vicinity of the boundaries of the area E.

Further, when light is irradiated over the entire surface of the photosensitive medium 2 (FIG. 4*e*) after the development by the second toner 4 so as to attenuate the surface potential of the photosensitive medium 2 at the areas on which no toner is attached (areas A and C and the edges of the area E) to Vr (FIG. 4*f*), the first toner particles located in the vicinity of the edges of the areas B and E are scattered to the areas A and C and the areas D and F, respectively, for the same reason as that described with reference to FIG. 4*b*, thereby blurring the images. At this time, the surface potential of the photosensitive medium 2 under the first toner images 1 becomes Vb because it is slightly attenuated by the light passing through the gaps formed between toner particles, even though the toner itself does not transmit light.

The present inventors have carried out intensive studies on the above-described problems, and have found that the scattering of toner particles occurs when the difference between the potentials of the toner image area and the adjacent areas reaches a certain value or is above such value. It has also been found that the toner scattering which occurs when the electrostatic latent images are erased by light occurs to a greater extent as the opacity of the toner increases.

SUMMARY OF THE INVENTION

This invention has been developed for the purpose of obviating the above noted disadvantages of the prior art. Accordingly, an object of the present invention is to provide a color electrophotographic method and apparatus of such exposure type that a light source scans a photosensitive medium in accordance with image signals containing pixel information into which an image to be exposed is divided which is capable of clearly reproducing images of different colors which are formed adjacent to each other. Another object of this invention is to provide a color electrophotographic method and apparatus which ensures the formation of non-blurred and clear color images, and which can in particular provide such color images when employing toners of opaque colors.

In the color electrophotographic method and apparatus of this invention in which a plurality of toner images of different colors are formed on a photosensitive medium by repetitions of a series of operations including the steps of charging, exposure and development the above-mentioned objects are achieved by conducting exposure of a photosensitive medium to a second image signal with a non-image area formed on the boundary between a first toner image and the second latent image when the second image is formed adjacent to the first toner image. As a result, difference in potential between the toner image and the adjacent image can be eliminated, thereby preventing scattering of the toner particles and ensuring that the obtained color image is not blurred and the colors of which are clear and of high purity.

DETAILED DESCRIPTION OF THE INVENTION

Photosensitive mediums suitable for use in the present invention contain those of selenium, phthalocyanine, amorphous silicone and organic photoconductive material. Suitable light sources include a general lamp, a semiconductor laser, a gas laser of He-Ne or other gases, combination of liquid crystal switching elements and a lamp, and a light-emitting diode. Any toners which are employed in general electrophotography can be employed in the present invention as a developer, including non-magnetic or magnetic one-component toners or non-magnetic or magnetic two-component toners. For full color printing, however, non-magnetic toner having a resistivity of $10^{10}$ Ω cm or above is preferable because it ensures that the colors are clear and of high purity.

Any developing methods can be applied to the present invention, preferable methods including that which employs electric field forces for the photosensitive medium to attract the toner particles, that which employs gaseous discharge to generate a current of air for carrying the toner particles to the photosensitive medium, and a toner-cloud method which employs a mechanically generated air stream to carry the particles to the photo-sensitive medium. The most suitable one is the non-contact developing method of DC electric field type in which the toner particles are moved in one direction toward the photosensitive medium by virtue of forces of a DC electric field. Suitable developing devices are of a type in which the developing operation can be switched over between operating condition and non-operating condition.

The principle of the present invention will be described below by way of example by referring to FIGS. 1*a* to 1*l*. In the following example, the photosensitive medium is positively charged and an image is formed through a negative-to-positive inversion. This principle is also applicable to image formation through a positive-to positive-process.

Figure 1A:
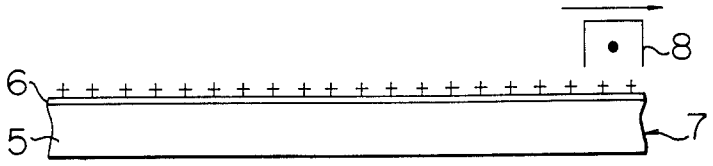
FIGS. 1*a* to 1*l* illustrate the principle of a color electrophotographic method according to the present invention.
Figure 1B:
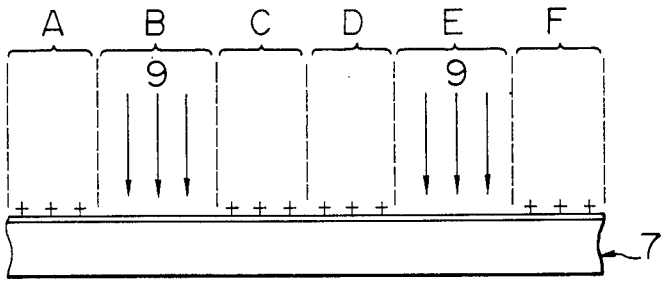
Figure 1C:
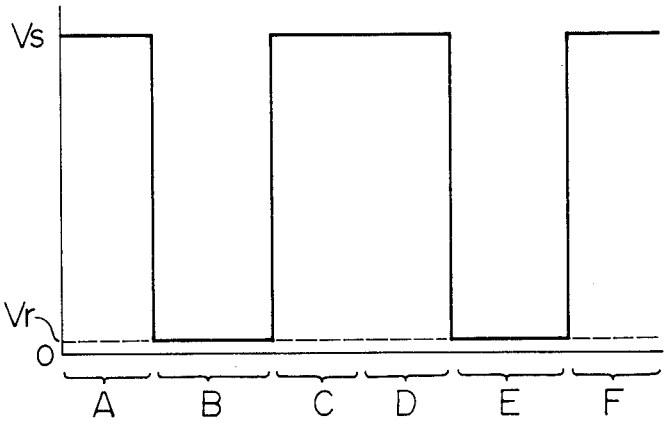

A photosensitive medium 7 which is made of a conductive substrate 5 with a photosensitive layer 6 provided thereon is charged to an electric potential of Vs (between +700 V and +1,200 V) by a corona charger 8 (FIG. 1*a*), and a first exposure 9 is then conducted (FIG. 1*b*) to form electrostatic latent images in such a manner that the difference between the surface potential Vr of the exposed portion (the areas B and E) and Vs is 500 V or above (FIG. 1*c*).

Figure 1D:
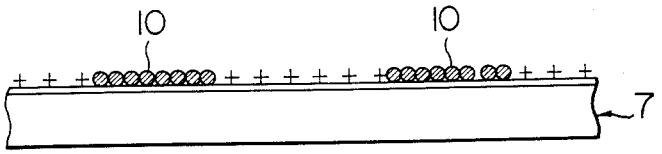
Figure 1E:
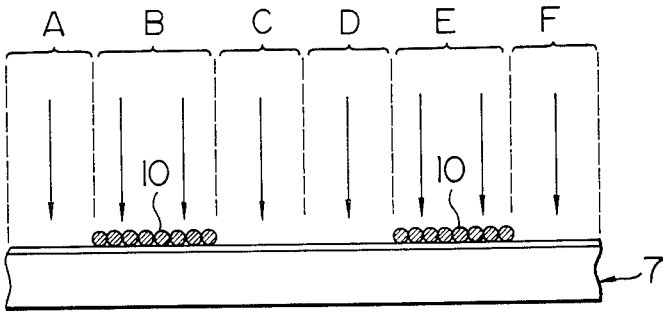
Figure 1F:
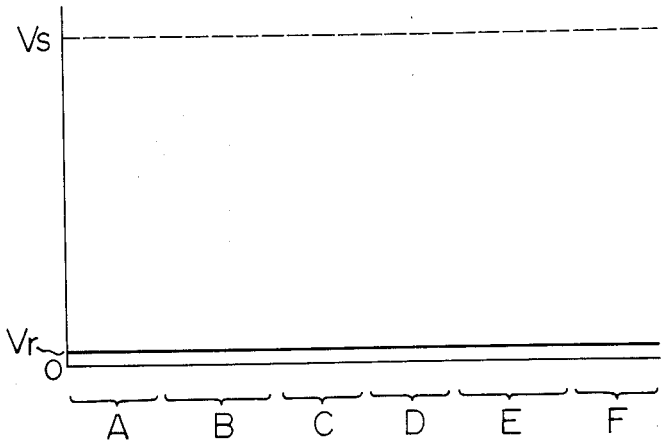

Subsequently, the electrostatic latent images thus formed are inverted and developed by a first toner 10 of an opaque color such as black (FIG. 1*d*). The entire surface of the photosensitive medium 7 is then irradiated with light to erase the electrostatic latent images (FIG. 1*e*). The erasure of the electrostatic latent images can be conducted such that the surface potential of the non-image portion (the areas A, C, D and F) is reduced to the residual potential Vr (0 to +100 V) of the photosensitive medium, as shown in FIG. 1*f*, if the erasure is that of the electrostatic latent images formed on the photosensitive medium by the first exposure. The attenuation may of course be such that the difference in the potentials of the image portion and the non-image portion is 500 V or less, as will be described later.

Figure 1G:
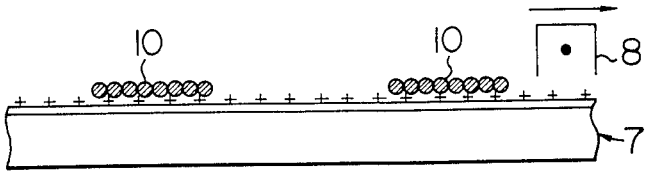
Figure 1H:
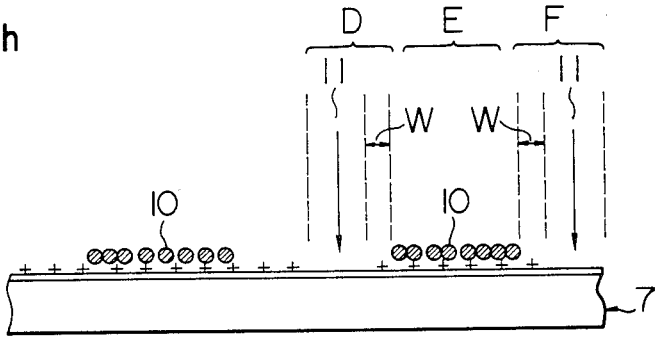
Figure 1I:
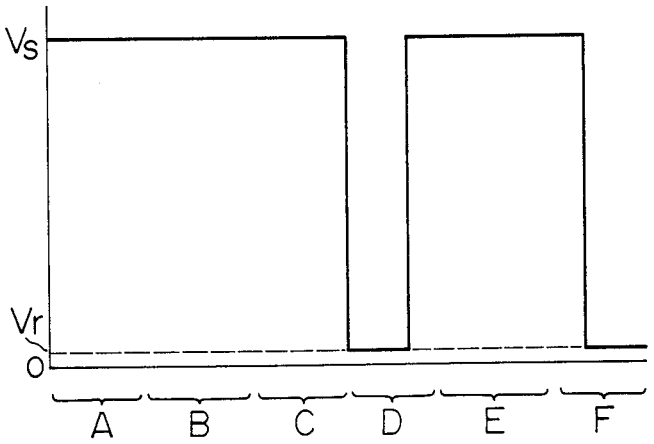
Figure 1J:
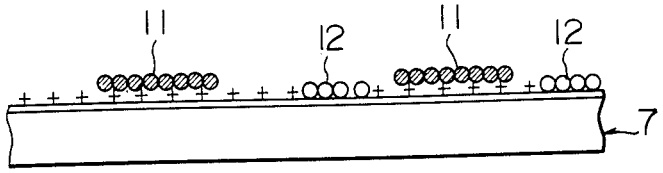
Figure 1K:
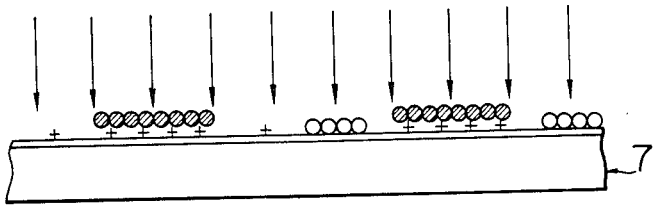
Figure 1L:
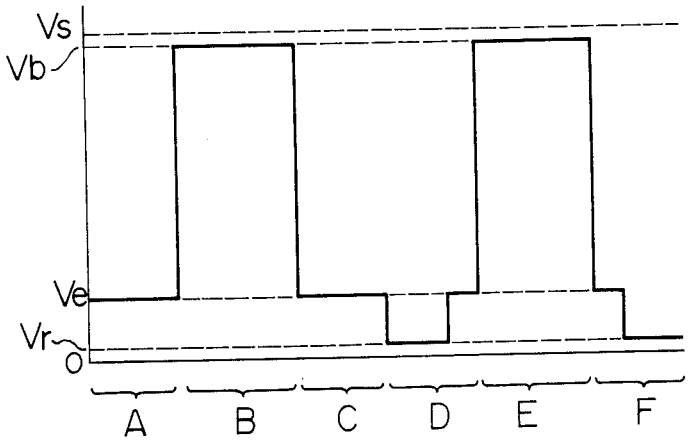

Next, the photosensitive medium 7 is again charged to Vs by the corona charger 8 (FIG. 1*g*). In the subsequent exposure of the areas D and F which is conducted for forming second toner images adjacent to the first toner image 10, these areas are exposed with minute gaps left at the edges thereof which are adjacent to the first toner image 10 (FIG. 1*h*) to prevent scattering of toner 10. FIG. 1*i* shows the potential of the photosensitive medium surface 7 after the second exposure. It is preferable that the width W of this minute gap is kept as small as possible. Although the desired value differs according to the potential of the electric charge applied to the surface of the photosensitive medium, the width W may be between 0.02 mm and 0.2 mm if the potential applied is 1,200 V or less. With such gaps formed adjacent to the edges of the areas D and F, the electric field strength generated at the edges of the toner image 10 by the second exposure decreases, and therefore no particles of the toner 10 are scattered.

Next, the electrostatic latent images formed in the second exposure are inverted and developed by a second toner 12 (FIG. 1*j*), and the entire surface of the photosensitive medium 7 is then irradiated with light (FIG. 1*k*) such that the difference between the surface potential of the areas A, C, D and F (that of the portion of the areas D and F which are exposed is Vr) Ve, and the surface potential of the areas B and E (which is slightly reduced to Vb by the light passing through the gaps formed between the toner particles, although the toner 10 itself does not transmit light, generally the difference in potentials between Vs and Vb being 100 V or less.) Vb, becomes 500 V or less, preferably, between 100 V and 500 V, as shown in FIG. 11. By adjusting the difference in potential in this way, the electric field strength at the edges of the toner image 10 is lowered, thus preventing scattering of the toner 10.

This results in clear toner images wherein colors are not mixed at the boundaries between the first toner image 10 and the second toner images 12.

In the example described above, neutralization of the applied electric charge is performed by using light. However, this may also be done by employing AC corona discharge.

EXAMPLE 1

Figure 2:
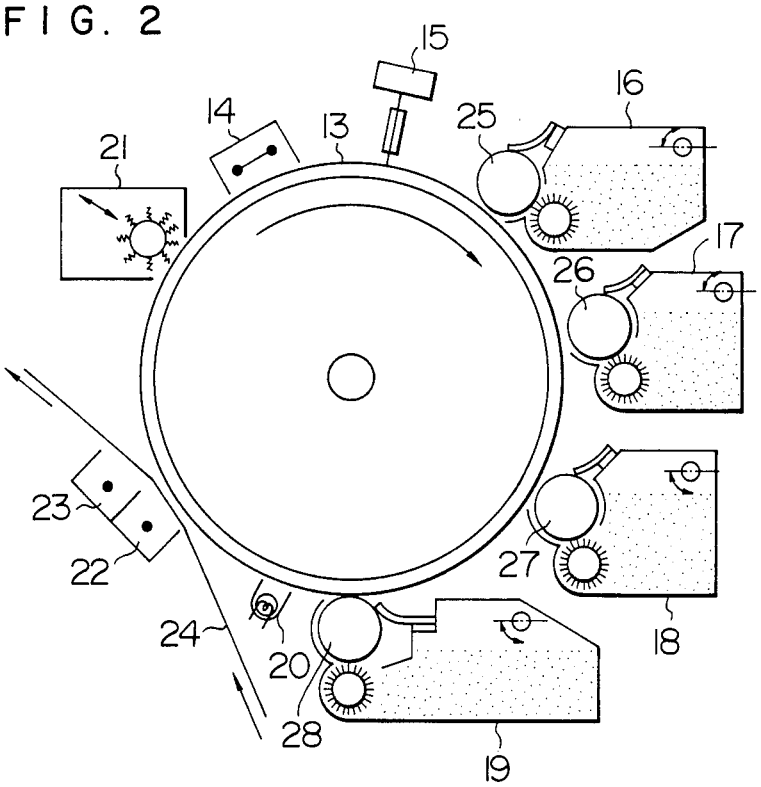
FIG. 2 schematically shows a color printer which utilizes the color electrophotographic method of the present invention.

FIG. 2 schematically shows a color printer which utilizes the color electrophotographic method of the present invention. It is to be noted that the arrangement of developing devices and the order of developments are not limited to those of this example.

The color printer includes: an aluminum photosensitive drum 13 with selenium-tellurium deposited thereon, a corona charger 14; a light source 15 which is a combination of a light-emitting diode array having an output wavelength of 660 nm and a pixel density of 16 dot/mm and a self-focusing rod lens array; electric field attraction type developing devices which respectively contain the toners of yellow (Y), magenta (M), cyan (C) and black (B1) 16, 17, 18, 19; a charge eliminating lamp 20; a cleaning brush 21; a transfer charger 22; a detach charger 23; and a paper sheet 24 onto which images are transferred.

Figure 3:
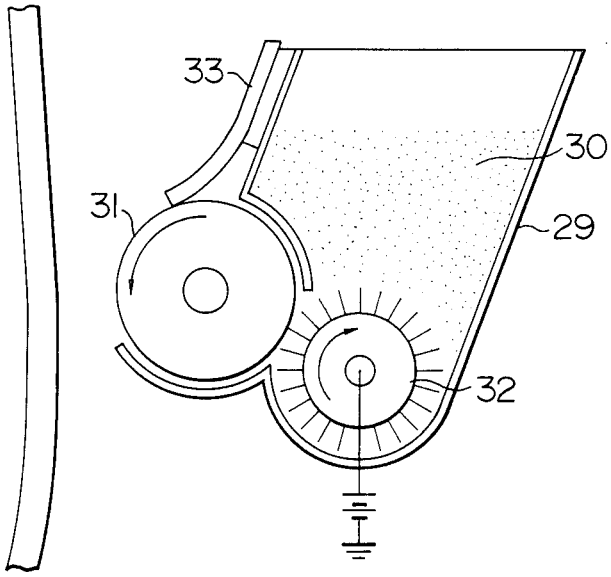
FIG. 3 is a schematic view of a developing device employed in the color printer of FIG. 2.
Figure 4A:
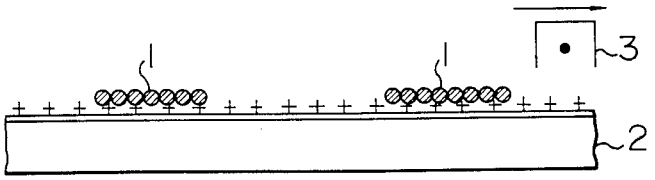
FIGS. 4*a* to 4*f* illustrate the disadvantages of known color electrophotographic methods.
Figure 4B:
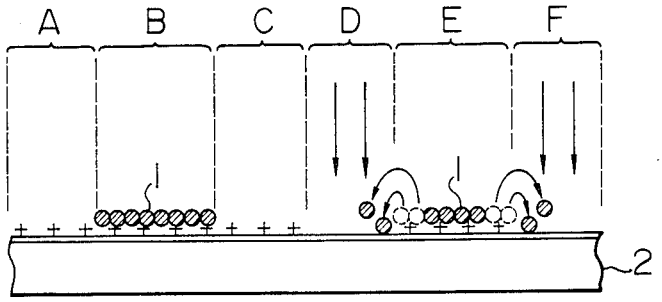
Figure 4C:
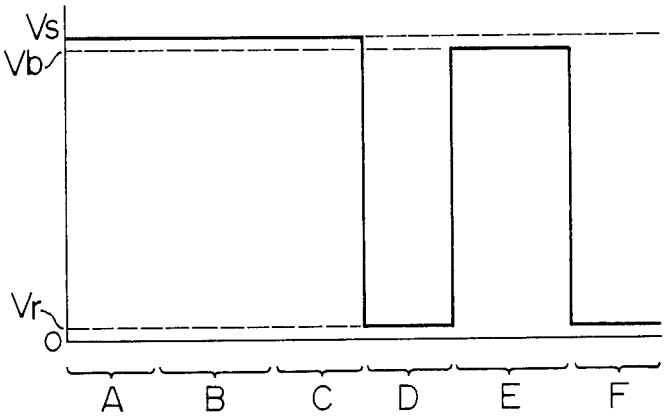
Figure 4D:
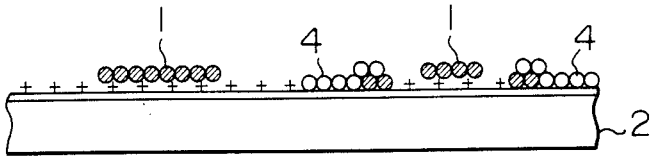
Figure 4E:
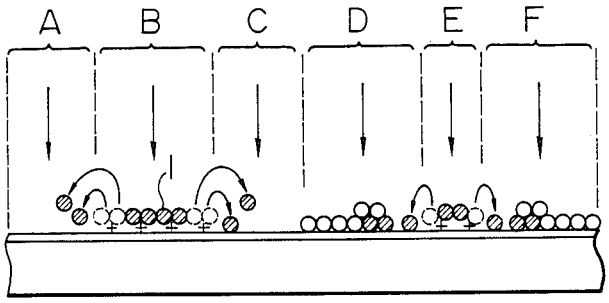
Figure 4F:
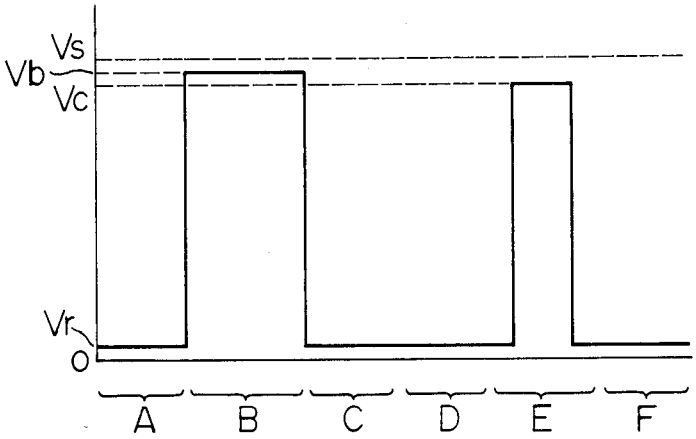

The developing devices 16, 17, 18, 19 are constructed basically in the same manner, and incorporate developing rollers 25, 26, 27, 28, respectively, for carrying a thin layer of toner. As shown in FIG. 3, each of the developing devices has a toner container 29, toner particles 30 contained in the container, a cylindrical aluminum developing roller 31, a conductive fur brush 32 which is an aluminum drum with a fur of rayon fibers with carbon dispersed therein planted thereon, the rayon fibers having a resistivity of $10^5$ Ω cm, a rubber blade 33 for thinning a layer of toner uniformly on the developing roller, and a power source for controlling the amount of toner to be supplied onto the developing roller.

In each developing device, the amount of toner supplied was adjusted such that thickness thereof on the developing roller 31 was between 20 and 50 μm by adjusting the pressing force of the rubber blade 33 and the voltage which was applied across the conductive fur brush 32 and the developing roller 31.

Each of the developing devices also has a mechanism for moving the developing device between a developing position which is 0.1 to 0.2 mm away from the photosensitive drum 13 and a non-developing position which is 0.7 mm or more away therefrom.

The toners of Y, M, C and B1 were a non-magnetic insulating toner the main components of which were resin and pigment. The mean particle diameter of each toner was 10 Ωm, while the allowance of electric charge and the resistivity were 2–5 μC/g and about $10^{13}$ Ωcm, respectively.

Next, a method of forming color images with the apparatus described above will be described below.

The surface of the photosensitive drum 13 was charged to a potential of +800 V by the corona charger 14 (corona voltage: +7 kV) while it was rotated in the direction of the arrow as shown. The photosensitive drum 13 was then scanned and exposed to black image signals contain pixel information relating to the image to be formed by the light source 15 to form negative electrostatic latent images. At this time, the potential on the non-image portion (non-exposed portion) was +800V, while that of the image portion (exposed-portion) was +50 V.

After the exposure, the developing rollers 25, 26, 27 of the respective developing devices 16, 17, 18 were grounded while a voltage of +750 V was applied only to the developing roller 28 of the developing device 19, and the photosensitive drum 13 was made to pass by the developing devices so that the black toner images were formed on the photosensitive drum at the appropriate pixel lecations. The drum was then irradiated by the charge eliminating lamp 20 to reduce the potential of the surface of the non-image portion to +50 V.

Subsequently, the photosensitive drum 13 carrying the black electrostatic latent images was charged a second time by the corona charger 14 (corona voltage: +7 kV), and the drum was then scanned and exposed to the yellow image signals by the light source 15. After the exposure, the photosensitive drum 13 was made to pass by the group of developing devices which were set in the following condition so as to form yellow toner images; a voltage of +750 V was applied to the developing roller 24 of the developing device 16 while the developing rollers of other developing devices 17, 18 19 were separated from the photosensitive drum through a distance of 0.7 mm or more to a non-developing position. Next, the photosensitive drum was irradiated by the charge eliminating lamp 20 so as to reduce the potential of the non-image portion to +300 V. The surface potential of the portion onto which the black toner particles were attached was +760 V.

Subsequently, the photosensitive drum 13 carrying the black and yellow toner images was charged a third time by the corona charger 14 (corona voltage: +7 kV), and the drum was then scanned and exposed to the magenta image signals by the light source 15. After the exposure, the photosensitive drum 13 was made to pass by the group of developing devices which were set in the following condition so as to form magenta toner images: a voltage of +750 V was applied to the developing roller 26 of the developing device 17 while the developing rollers of other developing devices 16, 18, 19 were separated from the photosensitive drum 13 through a distance of 0.7 mm or more to a non-developing position. Light was then irradiated to the drum by the charge eliminating lamp 20 so as to reduce the potential of the non-image portion to +300 V. The potential of the portion onto which the black toner particles were attached was +760 V.

Subsequently, the photosensitive drum 13 was charged a forth time by the corona charger 14 (corona voltage: +7 kV), and was then scanned and exposed to the cyan image signals by the light source 15. After the exposure, the photosensitive drum 13 was made to pass by the group of developing devices where were set in the following condition so that the electrostatic latent images formed by the exposure were developed by the cyan toner; a voltage of +750 V was applied to the developing roller 27 of the developing device 18 alone while the developing rollers of other developing devices 16, 17, 19 were separated from the photosensitive drum 13 through a distance of 0.7 mm or more to a non-developing position. Light was then irradiated by the charge eliminating lamp 20 so as to reduce the potential of the non-image portion to +300 V. The potential of the portion onto which the black and cyan toner particles were attached was +760 V.

After the color toner images thus formed on the photosensitive drum were transferred to the transfer paper sheet 24 by the transfer charger 22 which had a voltage of −5.5 kV, the charge on the transfer paper sheet 24 was neutralized by the detach charger 23 (removing voltage: ±7 kV) so as to separate the sheet from the photosensitive drum 13. The transfer paper sheet 24 carrying the color toner images was then thermally fixed to obtain a color print. After the transfer was completed, the toner particles left on the photosensitive drum 13 were cleaned by the cleaning brush 21 to get the drum ready for a subsequent image formation.

By using the above-mentioned apparatus, the images of different colors were formed adjacent to one another by exposing the photosensitive drum to subsequent image signals with a gap of about 0.06 mm formed between the edges of the previously formed toner images and the subsequent image. This width corresponds to one scanning line of the light source. This provided a clear color print colors of which were not mixed at all at the boundaries of the different colors. The non-image boundaries on which no development was conducted (which carry no images) were slightly narrowed through the processes of corona transfer of the toner images onto a transfer paper and thermal fixing, and were therefore virtually not able to be recognized.

The quality of the obtained color print was a general resolution of 14 dots/mm and a background fog density of 0.01, and no chromatic fogging or image blurring occurred.

COMPARISON EXAMPLE

A color print was obtained in the same manner as in the Example 1 with the exception that the potential of the surface of the non-image portion on which no toner particles were attached was attenuated to +50 V from +800 V when the surface charge was erased. The resultant color print had blurred black and cyan characters.

As can be seen from the above description, according to the present invention, it is possible to reproduce clear images of different colors which are formed adjacent to each other. It is also possible to obtain a color print of high resolution on which the images of different colors are formed adjacent to each other without decrease in the width of the images, and the colors of which are not blurred.

What is claimed is:

1. A color electrophotographic method employing a light source which scans a photosensitive medium to form an electrostatic latent image thereon in accordance with image signals containing pixel information relating to an image to be exposed to form a plurality of different-color toner images on said photosensitive medium by repetition of a series of charge, exposure and development processes, said method comprising the steps of:

(a) charging said photosensitive medium by a corona discharge technique;

(b) employing said light source to expose a first image on said charged photosensitive medium to form a first electrostatic latent image corresponding to said first image;

(c) developing said first latent image with first toner particles to form a first toner image on said photosensitive medium;

(d) applying one of an AC corona discharge and a light irradiation onto said photosensitive medium carrying thereon said first toner image to erase said first latent image;

(e) charging said photosensitive medium carrying thereon said first toner image by a corona discharge technique;

(f) employing said light source to expose a second image on said charged photosensitive medium adjacent said first toner image to form a second electrostatic latent image while maintaining non-image margins between said first toner image and said second latent image extending along edges of said first toner image, said non-image margins having a width within a range of 0.02 to 0.2 mm;

(g) developing said second latent image with second toner particles to form a second toner image on said photo-sensitive medium; and (h) applying one of a corona discharge and a light irradiation onto said photosensitive medium carrying thereon said second toner image to reduce a difference in contrast potential between image areas in said second latent image and said non-image margins to a value less than 500 V.

2. A color electrophotographic method according to claim 1, wherein said difference in potential is between 100 and 500 V.

3. A color electrophotographic method according to claim 1, wherein the development is a negative-to-positive inversion development.

4. A color electrophotographic apparatus having an optical writing light source for scanning a photosensitive medium to form an electrostatic latent image thereon in accordance with image signals containing pixel information relating to an image to be exposed to form a plurality of different-color toner images on said photosensitive medium by repetition of a series of charge, exposure and development processes, such that said plurality of toner images are thereafter transferred together simultaneously onto an image bearing medium, said apparatus comprising:

(a) a photosensitive medium movable between a beginning position and an end position;

(b) a corona discharger disposed adjacent an outer periphery of said photosensitive medium for charging said photosensitive medium;

(c) exposure means adjacent an outer periphery of said photosensitive medium for imagewise exposing said photosensitive medium to form an electrostatic latent image thereon, said exposure means comprising means for providing a non-image margin having a width within a range of 0.02 to 0.2 mm between developed images and electrostatic latent images;

(d) at least three single toner component developing devices disposed adjacent an outer periphery of said photosensitive medium, each comprising means for moving toner responsive to a DC electric field and respectively comprising storage means for storing developers of at least yellow, magenta and cyan, said developing devices being movable toward and away from said photosensitive medium;

(e) one of an AC corona discharger and a lamp for adjusting a contrast voltage between image parts and non-image parts of said electrostatic latent image formed on said photosensitive medium;

(f) means, cooperating with said at least three developing devices, for forming on said photosensitive medium a single color toner image during each complete movement of said photosensitive medium between said beginning position and said end position;

(g) means for controlling said one of said AC corona discharger and said lamp such that, when said photosensitive medium carrying thereon at least two different color toner images passes by said one of said AC corona discharger and said lamp, a potential difference between parts of said electrostatic latent image and non-electrostatic latent image parts on said photosensitive medium is set to be less than 500 V;

(h) a transfer charger for transferring said toner images of different colors onto an image bearing medium; and (i) a cleaner for cleaning said photosensitive medium after image transfer.

* * * * *